US007597192B2

(12) United States Patent
Lee

(10) Patent No.: US 7,597,192 B2
(45) Date of Patent: Oct. 6, 2009

(54) FILE FOLDER HAVING CASCADING ENVELOPES

(76) Inventor: Fei-Chen Lee, 12 Fl., No. 1, Lane 165 Yongheng Rd., Yonghe City, Taipei Hsien (TW)

( * ) Notice: Subject to any disclaimer, the term of this patent is extended or adjusted under 35 U.S.C. 154(b) by 856 days.

(21) Appl. No.: 11/179,613

(22) Filed: Jul. 13, 2005

(65) Prior Publication Data

US 2007/0012753 A1 Jan. 18, 2007

(51) Int. Cl.
*B65D 85/00* (2006.01)

(52) U.S. Cl. ..... 206/232; 206/425

(58) Field of Classification Search ..... 206/425, 206/472, 232, 45.2, 45.23, 45.24; 229/72
See application file for complete search history.

(56) References Cited

U.S. PATENT DOCUMENTS 3,999,819 A * 12/1976 Schreyer ..... 312/184
4,111,504 A * 9/1978 Montiel ..... 312/183
5,211,458 A * 5/1993 Yale ..... 312/193
5,271,502 A * 12/1993 Chang ..... 206/425
5,819,922 A * 10/1998 Martin, Jr. ..... 206/214
6,678,974 B1 * 1/2004 Su ..... 40/124.2
6,796,428 B1 * 9/2004 Ong ..... 206/425
6,945,399 B1 * 9/2005 Ong ..... 206/425
2002/0179475 A1 * 12/2002 Kohana ..... 206/425
2003/0029762 A1 * 2/2003 Ho ..... 206/425

* cited by examiner

*Primary Examiner*—Jacob K Ackun, Jr.
(74) *Attorney, Agent, or Firm*—Lowe Hauptman Ham & Berner, LLP

(57) ABSTRACT

A file folder includes a reinforced receptacle, a locking mechanism to secure engagement between a cover and a body of the receptacle, a first envelope movably received in the receptacle and multiple secondary envelopes sequentially correlated to one another and the first envelope, the second envelopes being movably received inside the receptacle such that movement of a reinforcing board which is securely engaged with a rear-most secondary envelope is able to pull all the secondary envelopes out of the receptacle.

12 Claims, 9 Drawing Sheets

FILE FOLDER HAVING CASCADING ENVELOPES

BACKGROUND OF THE INVENTION

1. Field of the Invention

The present invention relates to a file folder, and more particularly to a file folder with envelopes sequentially connected to one another.

2. Description of Related Art

A file folder normally has baffles to divide an interior of the folder into different compartments for receiving and managing files. A conventional file folder is shown in FIGS. 7, 8 and 9. The file folder is provided with a primary pocket (7) and secondary pockets (8) detachably connected to one another and the primary pocket (7). The primary pocket (7) is provided with an opening (70), a cover (72) foldably extending from a rear side face of the primary pocket (7), two tongues (73) stamped out of a front side face of the primary pocket (7), an elastic ring (74) formed on the rear side face of the primary pocket (7), a boss (75) formed on a front face of the cover (72) and a first slit (76) defined in the front side face of the primary pocket (7).

Each of the secondary pockets (8) is connected to another one and has an opening (80), a flap (82) foldably extending from a rear side face of the secondary pocket (8) and having a fixture (821) formed by stamping, two tongues (83) stamped out of a front side face of the secondary pocket (8), a slit (841) and hole (842) combination (84) defined side by side in a rear side face of the secondary pocket (8) and a second slit (85) defined between the two tongues (83).

When the conventional file folder is assembled, the flap (82) of each secondary pocket (8) is received in the opening (80) of a previous secondary pocket (8) with the fixture (821) inserted into a corresponding second slit (85) of the previous secondary pocket (8). The flap (82) of the final secondary pocket (8) is then inserted into the opening (70) of the primary pocket (7) with the fixture (821) inserted into the first slit (76) of the primary pocket (7). Furthermore, the two tongues (73) of the primary pocket (7) are inserted through corresponding holes (842) and then slits (841) of the final secondary pocket (8) and the tongues (83) of each of the secondary pockets (8) are inserted into corresponding holes (842) and slits (841) of the secondary pocket (8) in the front thereof. Therefore, when the secondary pockets (8) are interconnected and the final secondary pocket (8) is detachably connected to the primary pocket (7) with the fixture (821) inserted into the first slit (76) of the primary pocket (7), the conventional file folder is ready for use.

It is noted from FIGS. 7 and 8 that after the elastic ring (74) is moved away from engagement with the boss (75), the secondary pockets (8) are sequentially dropped out of the primary pocket (7). However, due to the interconnection between the tongues (83) and the slit and hole combination (84) in the secondary pockets (8) as well as the tongues (73) in the combination (84) of the final secondary pocket (8), the secondary pockets (8) tend to dangle from each other. As a result, when a large quantity of paper is inserted into any one of the secondary pockets (8), the secondary pocket (8) will deform and the documents contained in the secondary pocket (s) may fall out therefrom.

To overcome the shortcomings, the present invention tends to provide an improved file folder to mitigate the aforementioned problems.

SUMMARY OF THE INVENTION

The primary objective of the present invention is to provide a file folder having multiple envelopes sequentially connected to one another.

In one aspect of the present invention, the file folder of the present invention has a receptacle and multiple envelopes interconnected to one another via an attachment to bottom side faces of each of the secondary envelopes and received in the receptacle.

In yet another aspect of the present invention, the attachment is provided with multiple ridges and troughs, wherein the ridges are divided into a front-most ridge and second ridges. The front-most ridge is securely connected to a side face defining an interior of the receptacle and each of the second ridges is securely connected to a rear side face of a corresponding one of the secondary envelopes so that when the secondary envelopes are pulled out of the receptacle, the attachment helps the secondary envelopes to remain attached to the receptacle and present the secondary envelopes in a descending manner.

A further aspect of the present invention is that a locking mechanism is provided to the receptacle so that a user is able to use the locking mechanism to secure the secondary envelopes inside the receptacle.

Other objects, advantages and novel features of the invention will become more apparent from the following detailed description when taken in conjunction with the accompanying drawings.

DETAILED DESCRIPTION OF THE PREFERRED EMBODIMENT

Figure 1:
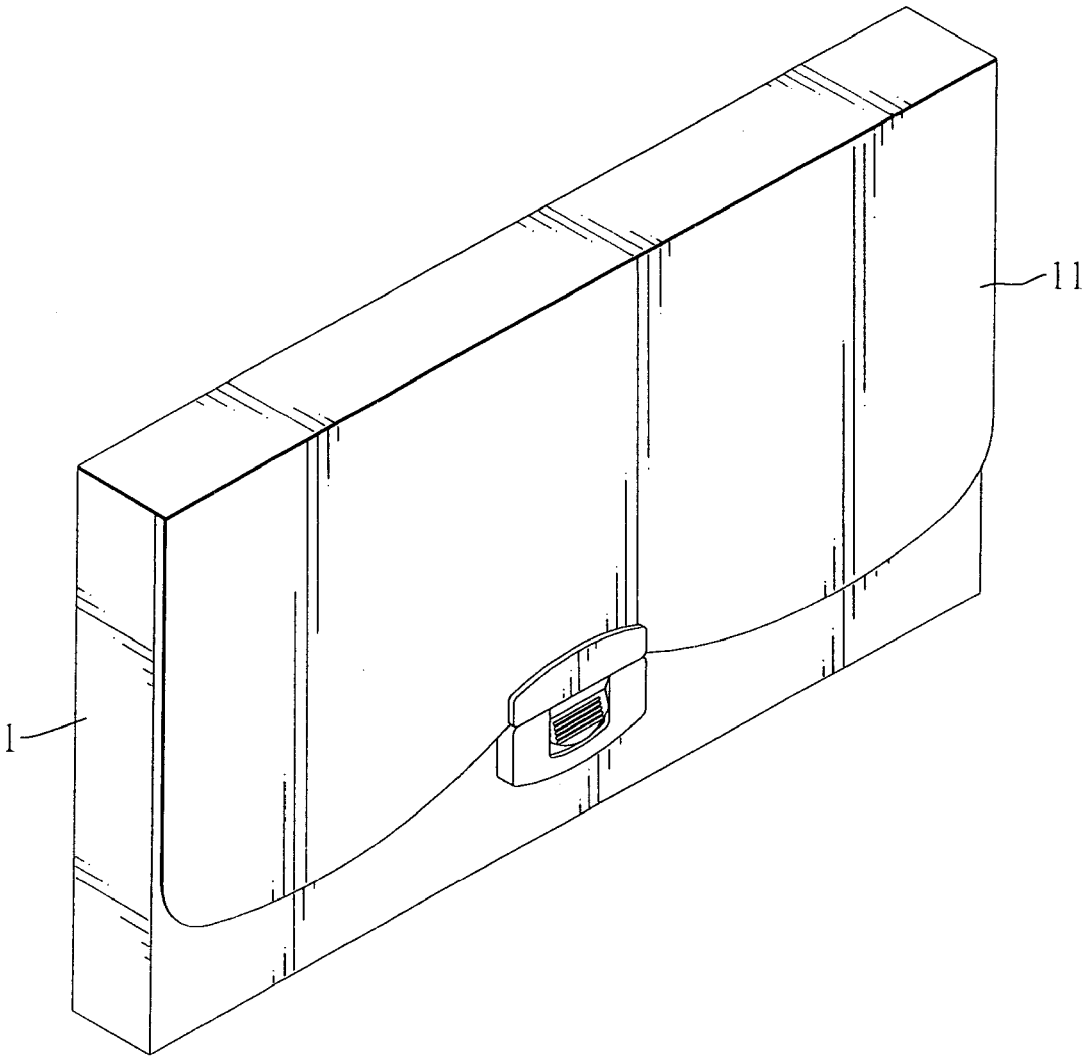
FIG. 1 is a perspective view of the file folder of the present invention, in a closed status.
Figure 2:
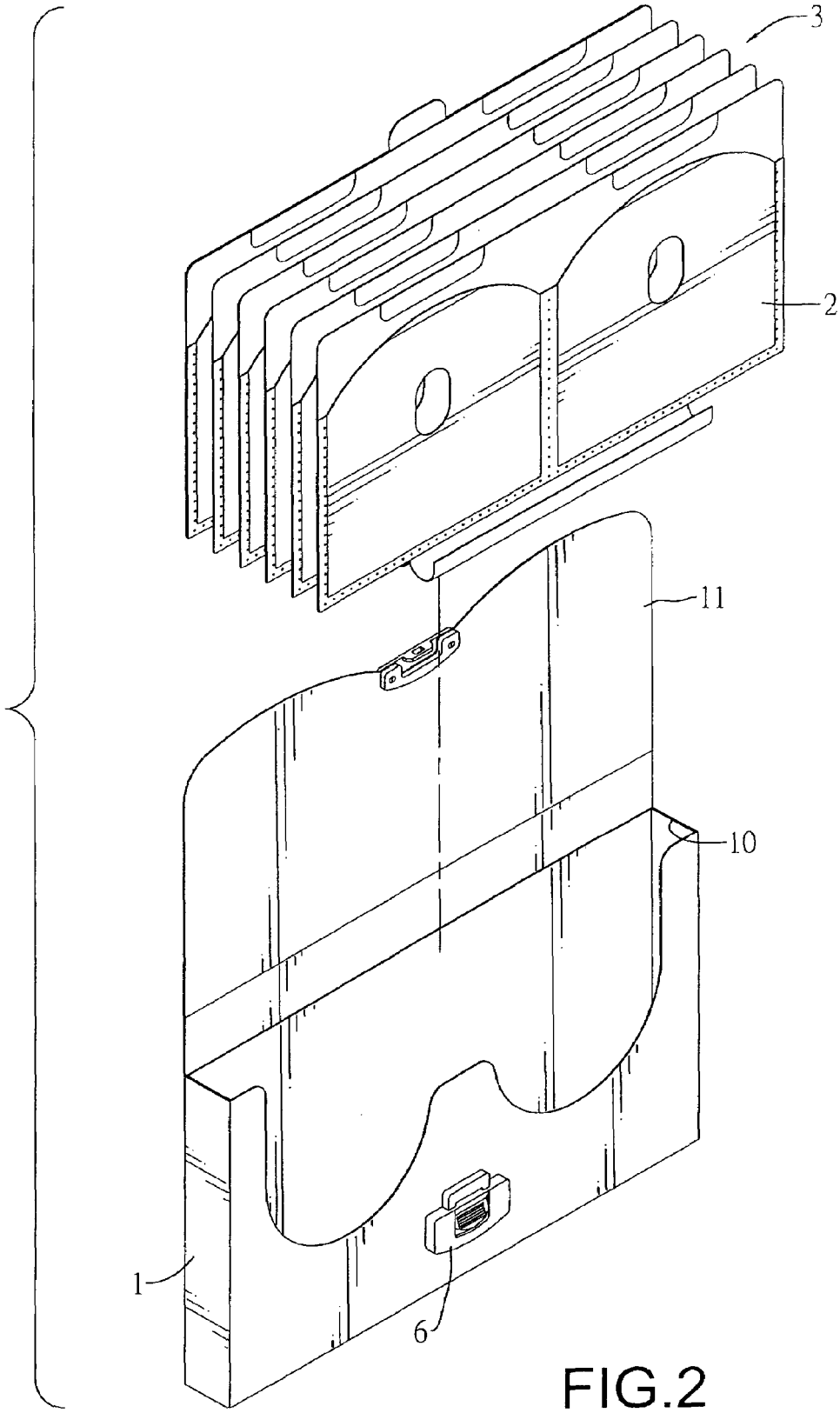
FIG. 2 is a partially exploded perspective view of the file folder of the present invention.

With reference to FIGS. 1 and 2, it is noted that the file folder in accordance with the present invention includes a receptacle (1) and envelopes respectively received in the receptacle (1). The envelopes are divided into a first envelope (2) and secondary envelopes (3).

The receptacle (1) is made of reinforced plastic and provided with an opening (10), a cover (11) foldably connected to a side face defining the opening (10) and a locking mechanism (6) formed on the cover (11) and a front side face of the receptacle (1).

Figure 3:
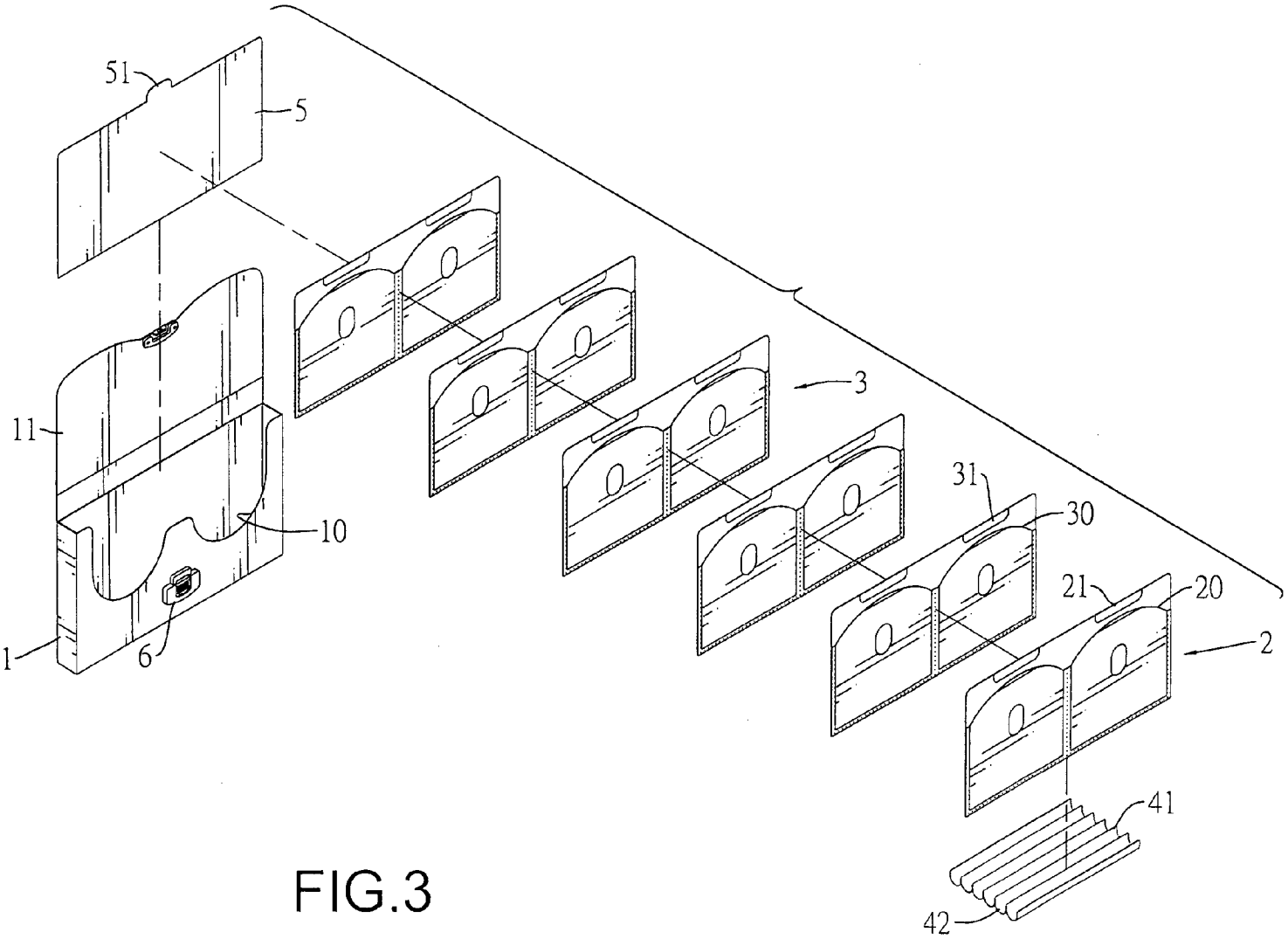
FIG. 3 is an exploded perspective view showing the structure of the secondary envelope and the attachment.

With reference to FIG. 3 and still using FIG. 2 for reference, the first envelope (2) as well as each of the secondary envelopes (3) has at least one opening (20,30) (two openings are shown in this preferred embodiment) and a tag receiving space (21,31) for receiving therein a tag (not shown) for facilitating identification of documents received inside the first envelope (2) or the secondary envelope (3).

An attachment (4) is provided to the first envelope (2) and every one of the secondary envelopes (3). The attachment (4) is undulated so as to have multiple ridges (41) and troughs (42). A reinforcing board (5) is provided to a final one of the secondary envelopes (3) and has a tab (51) extending from a top edge thereof. The reinforcing board (5) is securely attached to a rear side face of the final secondary envelope (3).

Figure 4:
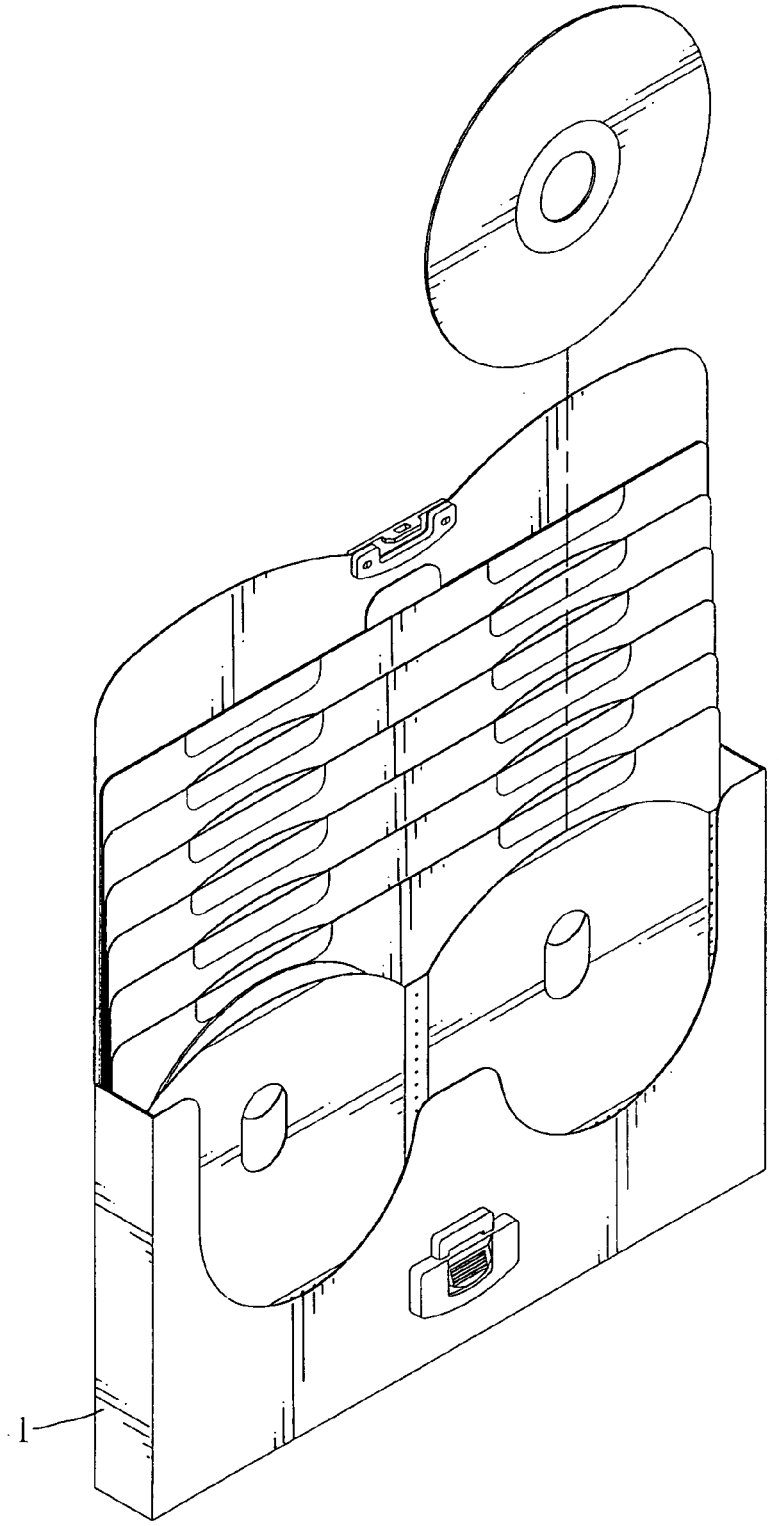
FIG. 4 is a schematic view showing that the file folder is employed for receiving therein compact disks.
Figure 6:
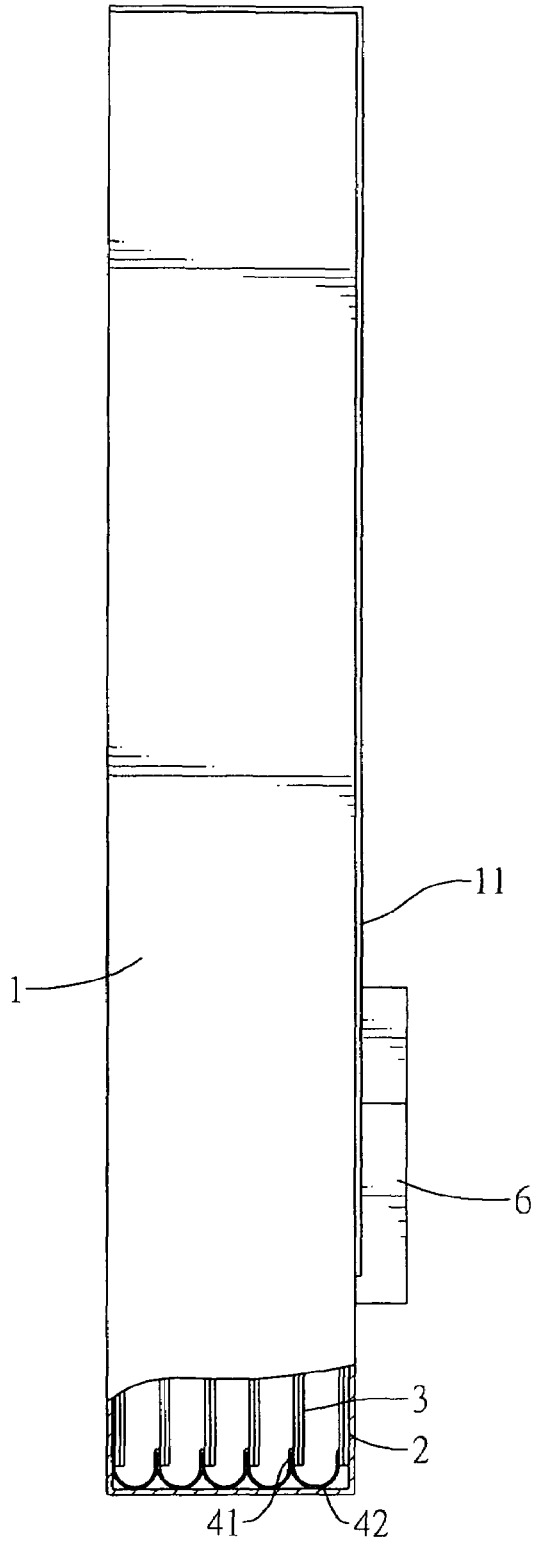
FIG. 6 is a schematic side plan view showing the arrangement of the attachment inside the receptacle.
Figure 7:
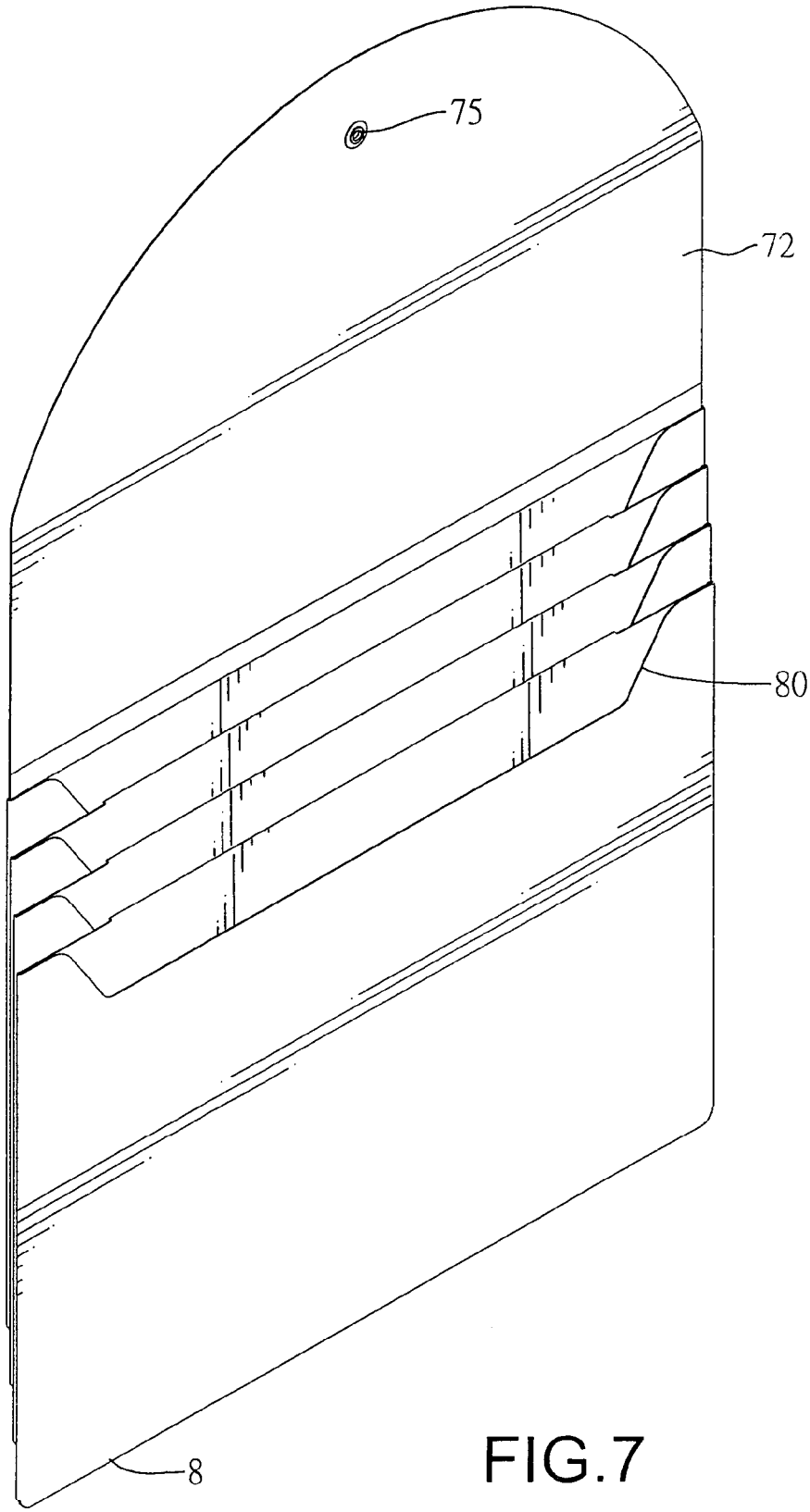
FIG.7 PRIOR ART
FIG. 7 is a perspective view showing a conventional file folder in an opened condition.
Figure 8:
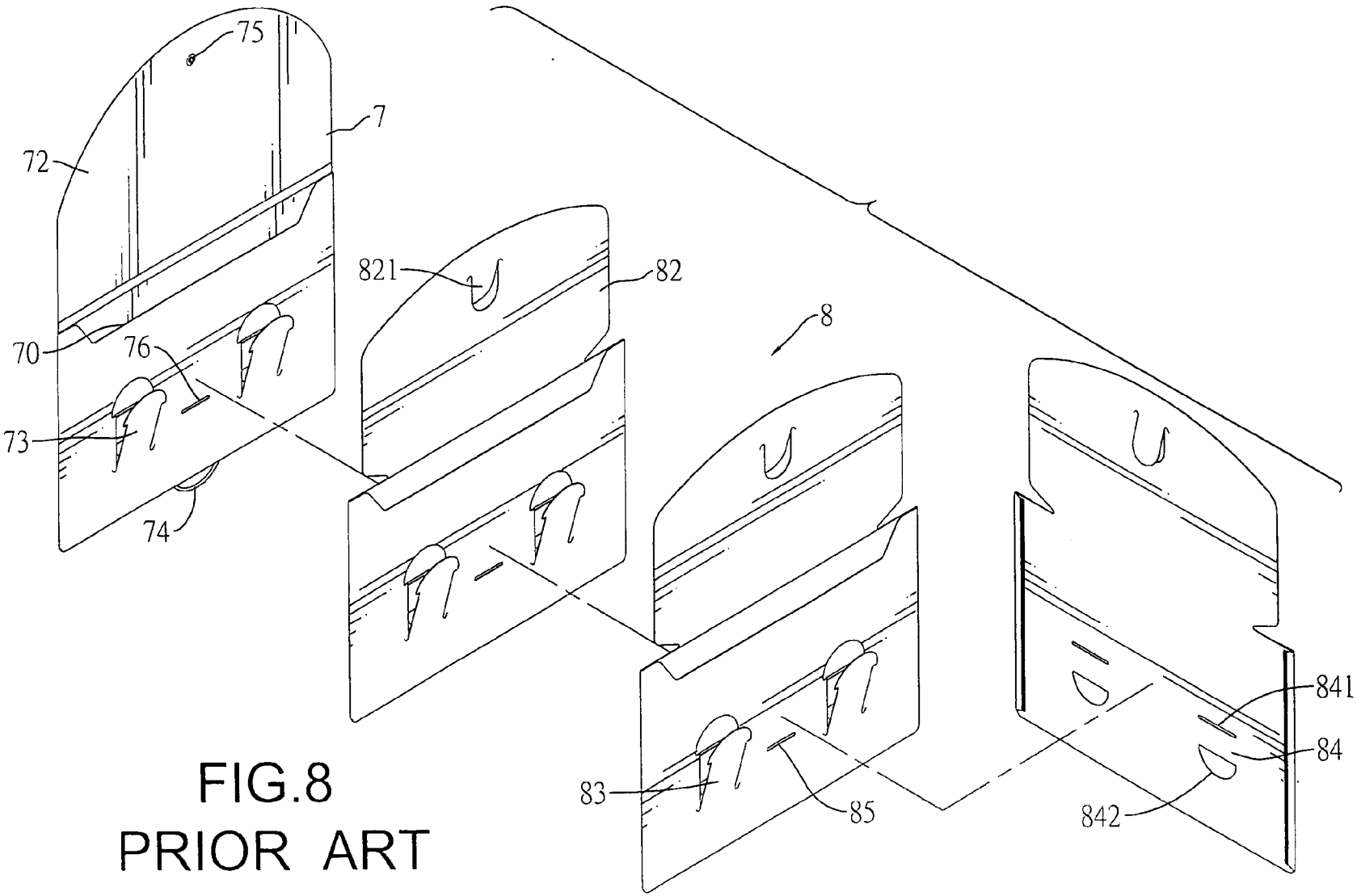
FIG.8 PRIOR ART
FIG. 8 is an exploded perspective view of the conventional file folder.
Figure 9:
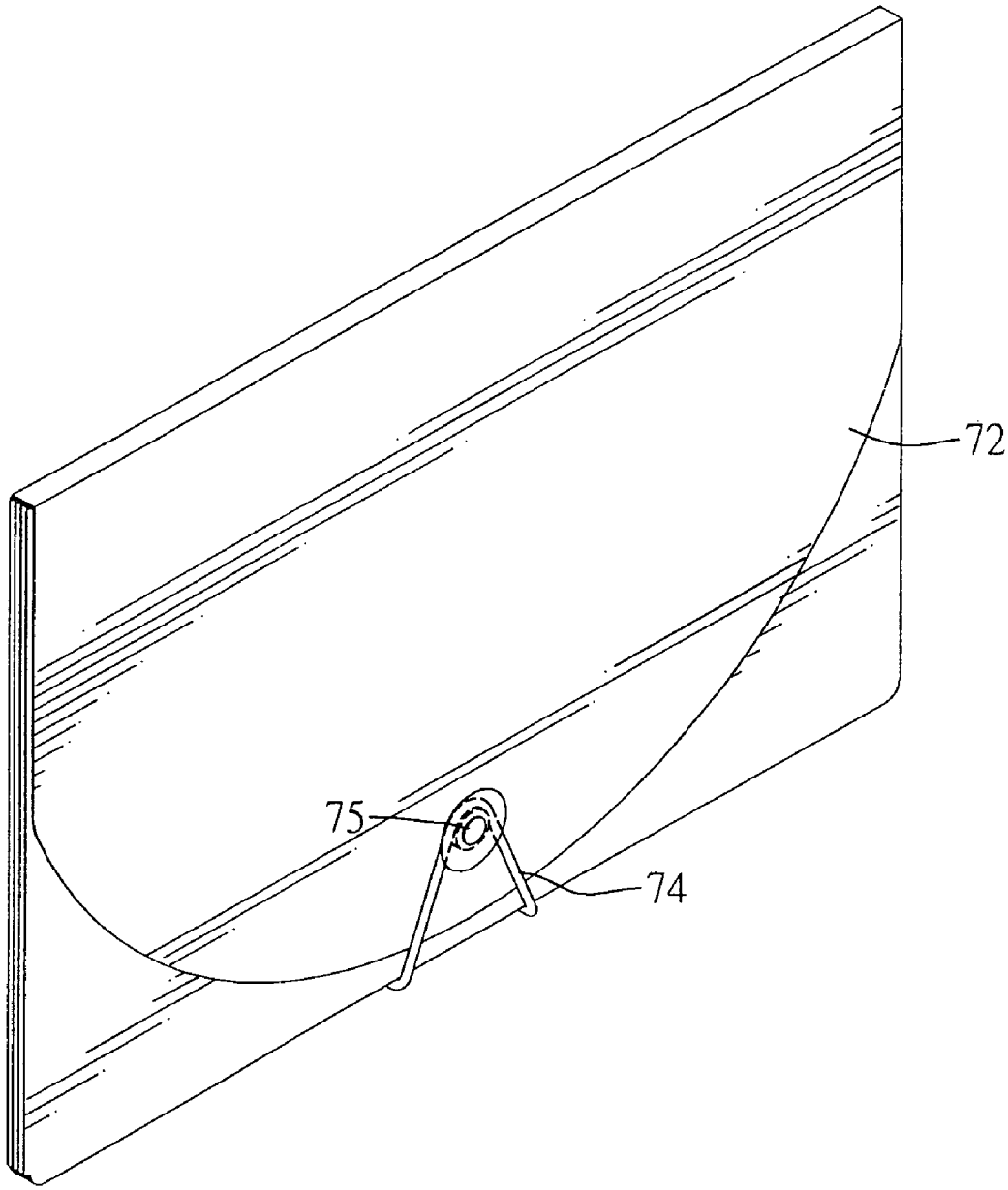
FIG.9 PRIOR ART
FIG. 9 is a perspective view showing that the secondary pockets are received inside the primary pocket after the elastic ring is engaged with the boss.

With reference to FIG. 4 and using FIGS. 3 and 6 for reference, it is noted that the ridges (41) are divided into a front-most ridge and second ridges. The front-most ridge is securely connected to a side face defining an interior of the receptacle (1) and each of the second ridges is securely connected to a rear side face of the first envelope (2) and a corresponding one of the secondary envelopes (3) so that when the secondary envelopes are pulled out of the receptacle (1) via pulling the tab (51) of the reinforcing board (5), the attachment (4) helps the secondary envelopes (3) as well as the first envelope (2) remain attached to the receptacle (1) and present the secondary envelopes (3) in a descending manner.

Figure 5:
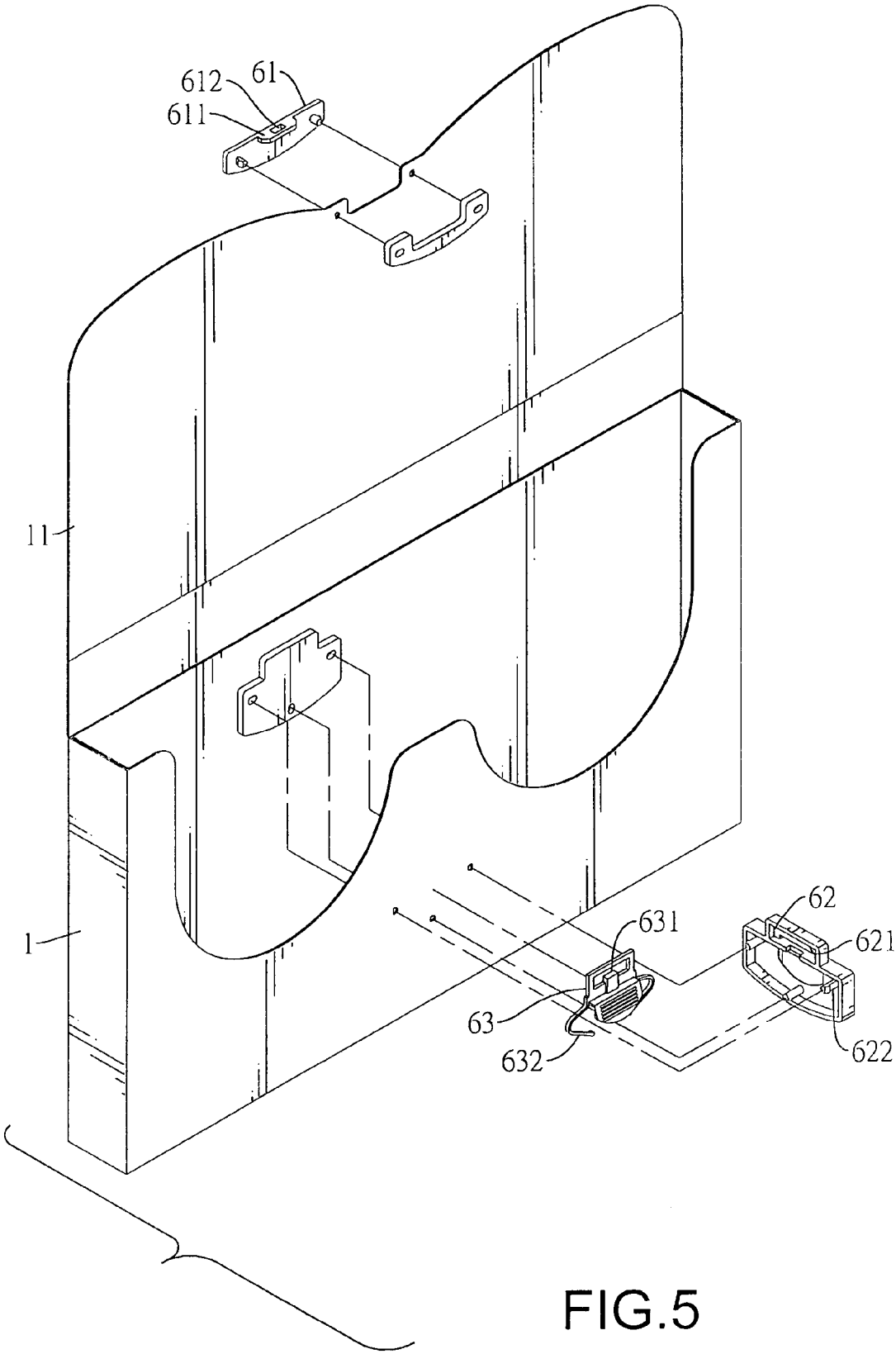
FIG. 5 is a perspective view of the receptacle in an opened condition, and showing a locking mechanism of the present invention.

With reference to FIG. 5, it is noted that the file folder of the present invention further has a locking mechanism (6) to secure engagement between the cover (11) and the body of the receptacle (1). The locking mechanism (6) includes an L-shaped tongue (61), a housing (62) and a resilient member (63).

The tongue (61) has a ledge (611) extending out of the tongue (61) and having a locking hole (612) defined through the ledge (611). The housing (62) is provided with a through hole (621) to correspond to the ledge (611) of the tongue (61) and two stops (622) respectively formed on two opposed sides inside the housing (62). The resilient member (63) is received inside the housing (62) and provided with a finger (631) extending to the through hole (621) of the housing (62) and two arms (632) respectively extending from two opposed sides thereof to abut a bottom side face of the housing (62). When the locking mechanism (6) of the present invention is assembled, the housing (62) is securely mounted on an outer side face of the front side face of the body of the receptacle (1) after the resilient member (63) is received inside the housing (62) with the two arms (632) respectively abutted by the two stops (622) and the finger (631) extending into the through hole (621) of the housing (62). Then after the tongue (61) is securely mounted on an outer side face of the cover (11), the ledge (611) is able to be inserted into the through hole (621). After the ledge (611) is inserted into the through hole (621), the finger (631) is first pushed away from the through hole (621) and further into the housing (62). However, after the locking hole (612) is in alignment with the through hole (621), because there is nothing forcing the finger (631) away from the through hole (621), the finger (631) is moved back into the through hole (621) by the recovery force from the two arms (632) such that the finger (631) is able to extend into the locking hole (612) of the tongue (61) so as to secure the enclosure from the cover (11) to the opening (10) of the receptacle (1).

From the above description, it is noted that the file folder of the present invention is able to store documents in an orderly manner due to the confinement of the receptacle (1) that is made of reinforced plastic. Also with the assistance of the tag receiving space (21,31) on top of the first envelope (2) and the secondary envelopes (3), after the first envelope (2) and the secondary envelopes (3) are sequentially pulled out of the receptacle (1), the user is able to clearly see and locate the document. Still further, because the first envelope (2) is securely attached to the bottom face of the receptacle (1) via the first ridge of the attachment (4) and the final secondary envelope (3) is securely attached yet movable relative to a rear side face of the receptacle (1), the file folder of the present invention is handy for displaying all the documents contained inside the receptacle (1).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A file folder comprising:

a reinforced receptacle having a cover to selectively close an opening of the receptacle;

a locking mechanism mounted on the receptacle to secure engagement between the cover and a body of the receptacle;

a first envelope movably received in an interior of the receptacle;

secondary envelopes securely yet movably received inside the interior of the receptacle;

an attachment having multiple ridges and troughs, wherein the ridges are divided into a front-most ridge and second ridges, the front-most ridge is securely connected to an inner side face of the interior of the receptacle and each of the second ridges are respectively attached to a rear side face of the first envelope and a corresponding one of the secondary envelopes; and a reinforcing board movably received in the interior of the receptacle and securely attached to a rear side face of a final secondary envelope of the secondary envelopes so that movement of the reinforcing board is able to pull out all the secondary envelopes in a descending manner.

2. The file folder as claimed in claim 1, wherein each of the secondary envelopes and the first envelope have a tag receiving space defined in a top face thereof for receiving a tag to facilitate identification of documents stored in each of the secondary envelopes and the first envelope.

3. The file folder as claimed in claim 2, wherein the reinforcing board has a tab formed on a top face thereof so that pulling the tab of the reinforced board is able to pull out every one of the secondary envelopes from the interior of the receptacle.

4. The file folder as claimed in claim 1, wherein the locking mechanism has a tongue mounted on the cover of the receptacle and having a ledge extending from the tongue and provided with a locking hole, a housing mounted on a front side face of the receptacle and having a through hole and a resilient member movably received in the housing and having a finger such that the finger is able to extend into the through hole of the housing and the locking hole of the ledge to secure the engagement between the cover and the body of the receptacle after the locking bole is in alignment with the through hole.

5. The file folder as claimed in claim 2, wherein the locking mechanism has a tongue mounted on the cover of the receptacle and having a ledge extending from the tongue and provided with a locking hole, a housing mounted on a front side of the receptacle and having a through hole and a resilient member movably received in the housing and having a finger such that the finger is able to extend into the through hole of the housing and the locking hole of the ledge to secure the engagement between the cover and the body of the receptacle after the locking hole is in alignment with the through hole.

6. The file folder as claimed in claim 3, wherein the locking mechanism has a tongue mounted on the cover of the receptacle and having a ledge extending from the tongue and provided with a locking hole, a housing mounted on a front side face of the receptacle and having a through hole and a resilient member movably received in the housing and having a finger such that the finger is able to extend into the through hole of the housing and the locking hole of the ledge to secure the engagement between the cover and the body of the receptacle after the locking hole is in alignment with the through hole.

7. A file folder comprising:

a reinforced receptacle having a cover to selectively close an opening of the receptacle;

a locking mechanism mounted on the receptacle to secure engagement between the cover and a body of the receptacle;

a first envelope securely connected to an inner side face of the reinforced receptacle;

secondary envelopes securely yet movably received in an interior of the receptacle;

an attachment having multiple ridges and troughs, wherein the ridges are divided into a front-most ridge and second ridges, the front most ridge is securely connected to an inner side face of the interior of the reinforced receptacle and each of the second ridges are respectively attached to a rear side face of the first envelope and a corresponding one of the secondary envelopes; and a reinforcing board movably received in the interior of the receptacle and securely attached to a rear side face of a final secondary envelope of the secondary envelopes so that movement of the reinforcing board is able to pull out all the secondary envelopes in a descending manner.

8. The file folder as claimed in claim 7, wherein each of the secondary envelopes and the first envelope have a tag receiving space defined in a top face thereof for receiving a tag to facilitate identification of documents stored in each of the secondary envelopes and the first envelope.

9. The file folder as claimed in claim 8, wherein the reinforcing board has a tab formed on a top face thereof so that pulling the tab of the reinforced board is able to pull out every one of the secondary envelopes from the interior of the receptacle.

10. The file folder as claimed in claim 7, wherein the locking mechanism has a tongue mounted on the cover of the receptacle and having a ledge extending from the tongue and provided with a locking hole, a housing mounted on a front side face of the receptacle and having a through hole and a resilient member movably received in the housing and having a finger such that the finger is able to extend into the through hole of the housing and the locking hole of the ledge to secure the engagement between the cover and the body of the receptacle after the locking hole is in alignment with the through hole.

11. The file folder as claimed in claim 8, wherein the locking mechanism has a tongue mounted on the cover of the receptacle and having a ledge extending from the tongue and provided with a locking hole, a housing mounted on a front side face of the receptacle and having a through hole and a resilient member movably received in the housing and having a finger such that the finger is able to extend into the through hole of the housing and the locking hole of the ledge to secure the engagement between the cover and the body of the receptacle after the locking hole is in alignment with the through hole.

12. The file folder as claimed in claim 9, wherein the locking mechanism has a tongue mounted on the cover of the receptacle and having a ledge extending from the tongue and provided with a locking hole, a housing mounted on a front side face of the receptacle and having a through hole and a resilient member movably received in the housing and having a finger such that the finger is able to extend into the through hole of the housing and the locking hole of the ledge to secure the engagement between the cover and the body of the receptacle after the locking hole is in alignment with the through hole.

* * * * *